United States Patent [19]

Johnson

[11] Patent Number: 4,679,771

[45] Date of Patent: Jul. 14, 1987

[54] CABLE TENSION SENSING APPARATUS

[75] Inventor: Bruce S. Johnson, Dallastown, Pa.

[73] Assignee: Harsco Corporation, Wormleysburg, Pa.

[21] Appl. No.: 690,532

[22] Filed: Jan. 11, 1985

[51] Int. Cl.[4] ..... B66D 1/50

[52] U.S. Cl. ..... 254/273; 188/5

[58] Field of Search ..... 254/270, 272, 273; 188/5, 7

[56] References Cited

U.S. PATENT DOCUMENTS

| | | | |
|---|---|---|---|
| 394,952 | 12/1888 | Baxter | 254/272 X |
| 2,445,228 | 7/1948 | Toruneau | 254/272 X |
| 2,636,577 | 4/1953 | Niedenthal | 188/7 |
| 2,717,057 | 9/1955 | Bankes | 188/5 |
| 3,012,520 | 12/1961 | Curtis | 254/273 X |
| 3,899,143 | 8/1975 | Slezak | 254/272 X |

FOREIGN PATENT DOCUMENTS

| | | | |
|---|---|---|---|
| 547935 | 10/1957 | Canada | 188/7 |
| 1126101 | 3/1962 | Fed. Rep. of Germany | 254/272 |
| 370040 | 8/1963 | Switzerland | 254/273 |

*Primary Examiner*—Stuart S. Levy
*Assistant Examiner*—Katherine Matecki
*Attorney, Agent, or Firm*—Kerkam, Stowell, Kondracki & Clarke

[57] ABSTRACT

Apparatus for sensing the tension in a cable and for maintaining the tension between a minimum tension and a maximum tension value comprises a rocker carrying a pulley about which the cable is passed, the rocker being pivotally supported for rotation between first and second rotational positions and being biased toward the first rotational position. Upon tension being applied to the cable, the rocker pivots away from the first position by an amount proporational to the cable tension. Spring biased plungers and associated switches sense the rocker being respectively at the first and second rotational positions and control the tension applied to the cable so as to maintain the tension between the selected minimum and maximum values.

22 Claims, 8 Drawing Figures

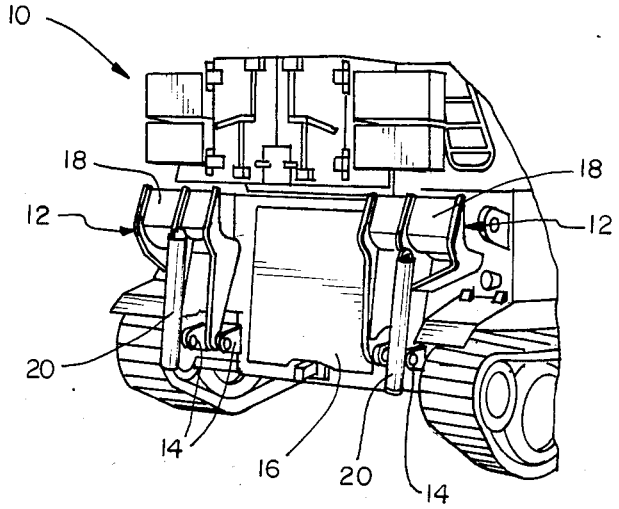
FIG 1
FIG 2
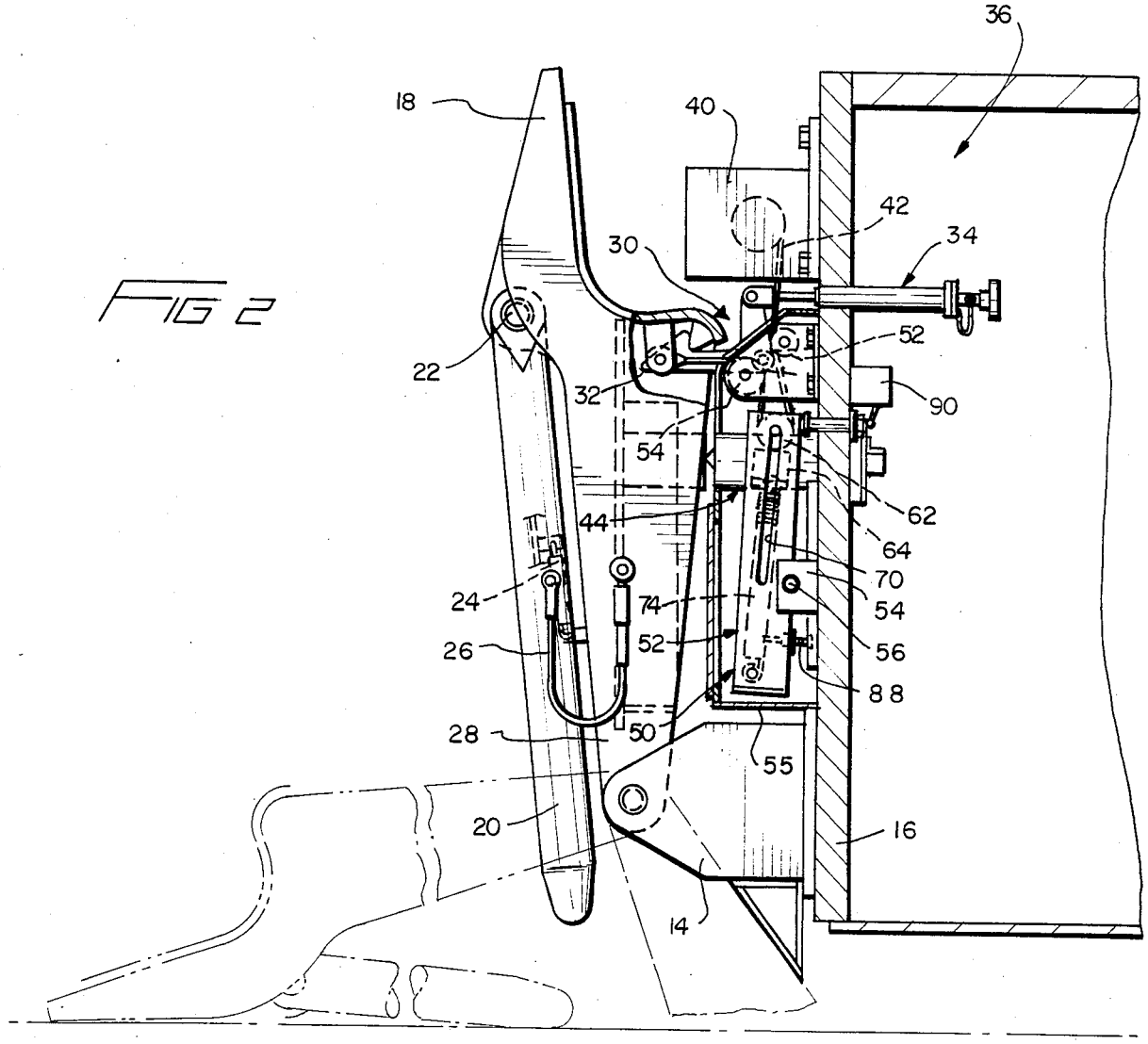

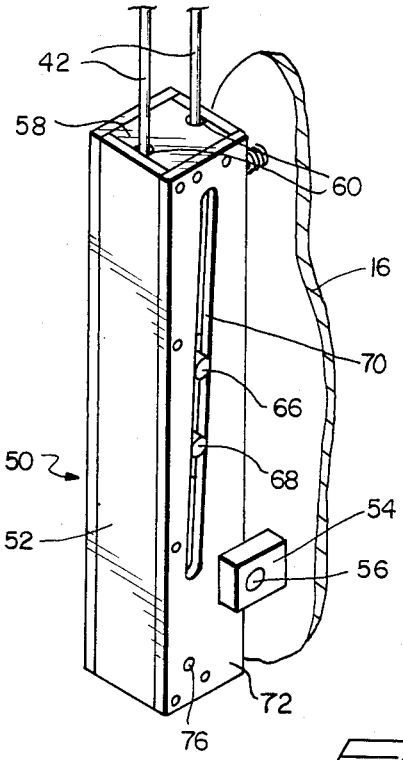
FIG 3
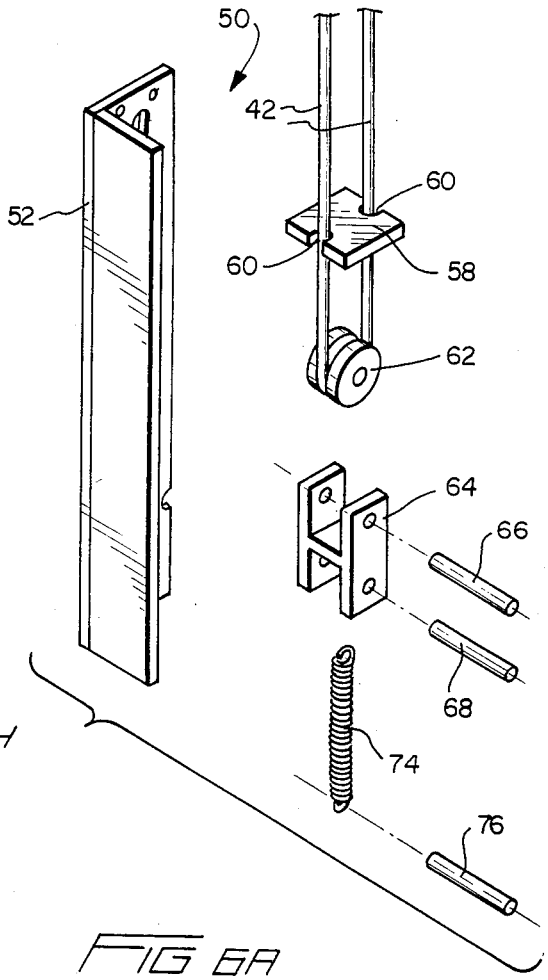
FIG 4
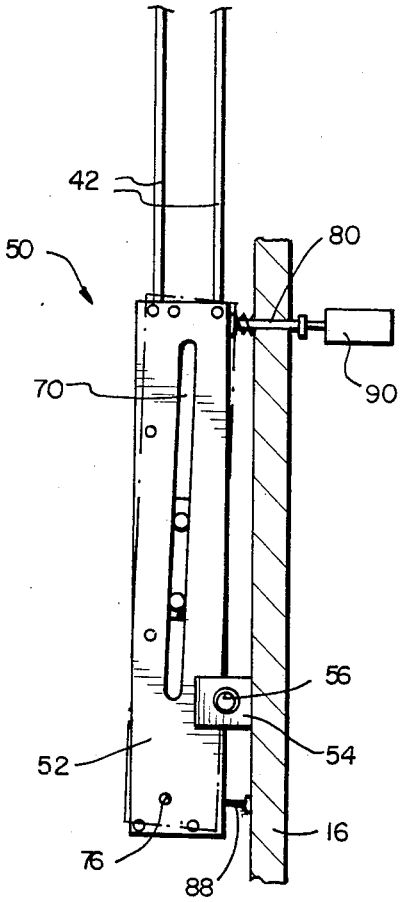
FIG 5
FIG 6A
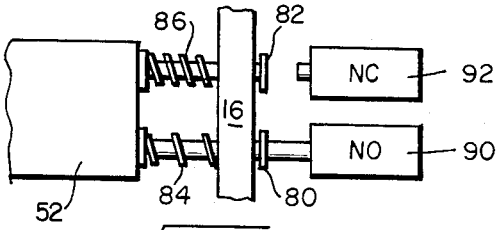
FIG 6B
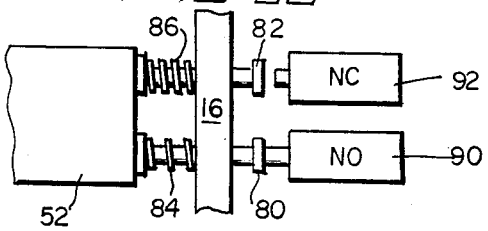
FIG 6C
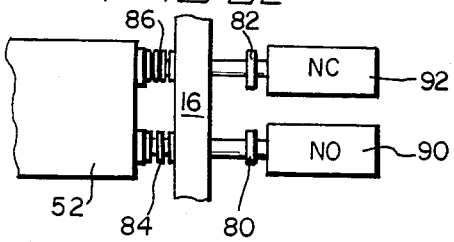

CABLE TENSION SENSING APPARATUS

BACKGROUND OF THE INVENTION

The present invention relates generally to cable tension sensing apparatus for winch-operated cable systems and the like, and more particularly to cable tension sensing apparatus for use with a retractable remote power spade system for anchoring a gun-carrying vehicle such as a tank, a howitzer or the like.

It is known to immobilize certain types of vehicles, such as construction or gun-carrying vehicles, with retractable ground-engaging stabilization devices to anchor the vehicle in a selected position. One form of such a stabilization device comprises spades pivotally mounted to the rear end of the vehicle which are lowered into engagement with the ground and raised to a traveling position by remote winch-operated cable systems. Locking devices may be provided for locking the spades in the raised or traveling position.

A problem encountered with such remote winch-operated cable systems, as well as with many other types of winch-operated cable hoists and the like, is maintaining proper tension in the cable, particularly where there may be no visual access to the cable system. Overtensioning of the cable, as, for example, by continuing to operate the winch to wind up cable after the spade has been locked in raised position, may cause the cable to snap. Likewise, undertensioning of the cable, as by allowing the winch to continue to unwind cable after the spades have engaged the ground, may produce excessive cable slack and allow the cable to become tangled, preventing the spades from being raised.

It is desirable to provide cable tension sensing apparatus for use with winch-operated and other types of cable systems which enables proper tension in a cable to be maintained, and it is to this end that the present invention is directed.

SUMMARY OF THE INVENTION

The invention affords rather simple, inexpensive apparatus for sensing the tension applied to a cable by a winch or other tension-applying means so as to enable overtensioning and/or undertensioning of the cable to be avoided. The invention enables the tension-applying means to be automatically controlled in accordance with the tension applied to the cable, and is particularly advantageous for use with a remote cable tensioning system. Furthermore, the invention may incorporate an auxiliary tension controlling mechanism which acts directly on the cable and which is particularly useful in situations where relative movement may occur between devices to which the ends of the cable are connected.

Briefly stated, in one aspect the invention affords apparatus for sensing the tension in a cable which includes a rocker pivotally supported on a member for rotation about a first axis. The rocker is biased to a first rotational position, and carries a pulley which is rotatable about a second axis substantially parallel to the first axis, the cable being passed around the pulley. The second axis is located so as to cause the rocker to pivot away from its first position upon tension being applied to the cable and to assume a second rotational position upon the cable tension reaching a predetermined maximum desired value. Means are included for detecting the rocker being at the second position and for controlling the tension applied to the cable in order to maintain the tension less than or equal to the predetermined maximum desired tension.

More specifically, the detecting means may also detect the rocker being at the first rotational position, which may correspond to a predetermined minimum desired cable tension, and control the cable tension in order to maintain the tension equal to or greater than a predetermined minimum desired tension. The detecting means may comprise switches which control the tension-applying means and which are operated in accordance with the rotational position of the rocker by plungers arranged to engage the rocker. In addition, the pulley may be slidably carried by the rocker and biased by a spring in an opposite direction from that in which a force is applied to the pulley by the cable. This enables relative movement between the pulley and the rocker so as to compensate for a varying tension being applied to the cable.

In another aspect, the invention affords an apparatus for maintaining the tension in a winch-controlled cable system between minimum and maximum tension limits which comprises a housing pivotally supported on a member for movement between first and second rotational positions, the housing having an entrance and an exit opening for the cable and a pulley disposed within the housing with respect to the entrance and exit openings so as to enable the cable to be passed around the pulley. The housing is biased to the first rotational position by biasing means, and is caused to pivot away from the first rotational position and toward the second rotational position upon tension being applied to the cable. The biasing means is selected such that the first rotational position corresponds to the minimum cable tension limit and such that the second rotational position corresponds to the maximum cable tension limit. Means are included for detecting the rotational position of the housing and for preventing unwinding of the cable from the winch when the housing is in the first position and for preventing wind up of the cable by the winch when the housing is in the second position. The apparatus may be employed with a retractable ground-engaging spade system for anchoring a gun-carrying vehicle in a selected implaced position.

Other features and advantages of the invention will become apparent from the description which follows.

BRIEF DESCRIPTION OF THE DRAWINGS

FIG. 1 is a perspective view of a portion of a gun-carrying vehicle or the like having retractable ground-engaging spades with which the invention may be employed;

FIG. 2 is an enlarged side view, partially in cross section and partially broken away, of a portion of FIG. 1 illustrating the invention being employed with a winch-controlled cable for raising and lowering one of the spades;

FIG. 3 is a perspective view of cable tension sensing apparatus in accordance with the invention;

FIG. 4 is an exploded partial perspective view of the apparatus of FIG. 3;

FIG. 5 is a side view illustrating schematically the operation of the cable tension sensing apparatus; and FIGS. 6A–C are top views illustrating schematically the operation of the cable tension sensing apparatus.

DESCRIPTION OF THE PREFERRED EMBODIMENT

As noted earlier, the invention is particularly well adapted for sensing and controlling cable tension in a remote cable system such as is employed for raising and lowering the anchoring spades of a gun-carrying vehicle, such as a tank, and will be described in that context. As will become apparent, however, the invention is also applicable to cable systems employed for hoists and other similar devices.

FIG. 1 illustrates a portion of a tracked vehicle 10 such as a tank or a self-propelled howitzer or the like having a pair of retractable spades 12 pivotally supported at their lower (in FIG. 1) ends by brackets 14 attached to the rear wall 16 of the vehicle. Spades 12 may be generally of known form and, as shown in FIGS. 1 and 2, may comprise a blade portion 18 shaped to dig into the ground upon the spade being lowered and the vehicle being moved backwards, and a ground-engaging strut 20 pivotally connected to the blade portion, as at 22, and connected by a spring 24 and a retaining cable 26 to an arm 28 of the spade. When not in use, the spades are adapted to be latched in an upright or traveling position (the position illustrated in FIGS. 1 and 2) by a latch mechanism 30 comprising a latching member 32 pivotally disposed on the rear wall 16 which is operated by a latch release 34 located within the interior 36 of the vehicle. Each of the spades may be lowered and raised by a power winch 40 and cable 42 disposed on the rear wall as shown in FIG. 2. The winch may be electrically driven, for example, and may be operated from the interior of the vehicle. A push-off device 44 comprising a manually or power operated plunger, for example, may also be disposed in the rear wall for pushing the spade away from the rear wall to initiate its rotation from a raised to a lowered position upon the latch mechanism being released.

In accordance with the invention, cable tension sensing apparatus 50 may be disposed on the rear wall of the vehicle, as shown in FIG. 2, for sensing and controlling the tension in cable 42. Cable 42 from the winch may be routed by means of a pair of rollers or pulleys 62 and 64 through the tension sensing apparatus 50 prior to the cable being connected to the spade, as shown in FIG. 2, and the apparatus and pulleys may be enclosed by a protective cover 55. As will be described in more detail shortly, cable tension sensing apparatus 50 senses the tension in the cable and may control the winch to maintain the cable tension between predetermined minimum and maximum values. The minimum tension value may correspond to no tension in the cable to prevent the winch from playing out excess cable which could possibly become tangled when the spade is in its lowered position, and the maximum tension value may be selected to be a value (less than the breaking strength of the cable) to prevent continued wind up of the cable by the winch after the spade has been latched in its upright position. Apparatus 50 may also incorporate an auxiliary tension controlling mechanism to compensate for tension variations in the cable when the spades are lowered due, for example, to recoil forces produced by firing of the vehicle's gun.

As shown in FIGS. 2, 3 and 5, the tension sensing apparatus 50 may comprise a rocker assembly 52 pivotally connected to the rear wall 16 of the vehicle by means of brackets 54 for rotation about a substantially horizontal axis 56. As best shown in FIG. 4, rocker assembly 52 may comprise an elongated housing having a guide block 58 with openings 60 therethrough for the cable constituting one end of the housing. A pulley or grooved roller 62 may be rotatably connected to a yoke 64 by a pin 66, and the yoke and pulley may be slidably carried within the housing by locating pin 66 and another pin 68 through the yoke within generally longitudinally extending guide slots 70 formed in opposite sidewalls 72 of the housing. The yoke and pulley may be biased to the lower (in the figures) end of slots 70 by a spring 74 connected to pin 68 of the yoke and to the lower end of the housing, for example to another pin 76 which extends through the lower end of the sidewalls 72. Cable 42 is guided into and out of the housing by openings 60 in guide block 58 and is passed around pulley 62. As is shown in the figures, guide slots 70 extend generally parallel to the direction in which the cable enters and leaves the housing and may be at a slight angle to the longitudinal center line of the housing. The slots extend from a location adjacent to the end of the housing constituted by the guide block 58 to a location adjacent to the axis 56 about which the housing is pivoted. Axis 56 is offset transversely with respect to the slots, preferably toward the edge of the sidewalls 72 adjacent to rear wall 16, and is preferably located closer to the lower (in the figures) end of the housing than to the upper end through which the cable enters and exits. Thus, the axis of rotation of the pulley 62 formed by pin 66 is substantially parallel to the axis 56 about which the housing is pivoted, but is offset both vertically and horizontally from axis 56. Accordingly, when tension is applied to the cable, an equivalent force is exerted on the housing by spring 74 which produces a moment that tends to rotate the housing in a clockwise (in the figures) direction about axis 56, as indicated in FIG. 5. Therefore, by biasing the housing to a predetermined counterclockwise rotational position, the degree to which the housing pivots clockwise away from that position will be proportional to the amount of tension applied to the cable. The invention senses this tension by detecting the rotational position of the housing, in a manner which will now be described.

As best illustrated in FIGS. 6A–C, a pair of spring loaded plungers 80 and 82 having compression springs 84 and 86, respectively, coaxially disposed thereon may extend through the rear wall 16 of the vehicle and engage the housing adjacent to its upper end 58. The springs bias the plungers outwardly from the rear wall and, by virtue of the engagement between the plungers and the housing, bias the housing counterclockwise toward a predetermined rotational position which is established by engagement of a set screw 88, located adjacent to the lower end of the housing, with the rear wall 16. The maximum counterclockwise rotational position of the housing may be adjusted by adjustment of the set screw to correspond to the minimum cable tension sensed by the apparatus, as will be described shortly. Upon tension being applied to the cable, the housing pivots in a clockwise direction from its maximum counterclockwise rotational position (as previously described) and depresses plungers 80 and 82 against the bias forces of springs 84 and 86, causing the plungers to move inwardly into the interior of the vehicle. FIGS. 6A–C illustrate the relative positions of the housing and the rearwall 16 (and the degree of depression of the plungers) for three different rotational positions of the housing corresponding, respectively, to minimum cable tension, an intermediate cable tension, and maximum cable tension.

As shown in FIG. 6A, spring 84 may have a greater length than spring 86. The length of spring 84 is preferably selected such that when the housing is in its maximum counterclockwise rotational position, spring 84 is either just at its maximum length or is somewhat slightly compressed. The length of spring 86, however, may be selected such that compression does not begin until the housing reaches an intermediate rotational position, such as that illustrated in FIG. 6B. Accordingly, spring 84 acting alone through plunger 80 serves to bias the housing to its maximum counterclockwise rotational postion. In addition, spring 84 is preferably selected to have a rather light spring constant so that it is easily compressed, whereas spring 86 is preferably selected to have a substantially heavier spring constant so that it requires a substantially greater force for compression. The use of springs having different spring constants is convenient for enabling a large difference between minimum and maximum tension values to be sensed. A light spring constant for spring 84 is desirable to enable rather small cable tensions to be readily sensed, whereas a heavy spring constant for spring 86 is desirable to afford a rather large cable tension limit. The spring constant of spring 84 should be sufficient to ensure rotation of the housing to its predetermined counterclockwise rotational position at the minimum cable tension limit desired, and the spring constant of spring 86 should be sufficient to ensure that spring 86 is not fully compressed prior to the maximum cable tension limit being reached.

Tension is sensed by detecting the amount of depression of the plungers 80 and 82. As best illustrated in FIGS. 6A–C, a pair of switches 90 and 92 may be positioned within the interior of the vehicle adjacent to rear wall 16 so as to be respectively actuated by plungers 80 and 82. Switch 90, which may be a normally open (NO) switch, may be employed for enabling the operation of the winch in a direction to unwind cable when it is actuated, and switch 92, which may be a normally closed (NC) switch, may be employed for disabling the operation of the winch in a direction to wind up cable when it is actuated. As previously noted, and as shown in FIGS. 6A–C, the penetration distance of the plungers into the interior of the vehicle is a function of the relative rotational position of the housing relative to the rear wall, which in turn is generally proportional to the tension applied to the cable. Switch 90 is therefore positioned relative to plunger 80 such that the point at which it is actuated, which is preferably for all rotational positions of the housing other than the maximum counterclockwise clockwise rotational position, corresponds to minimum cable tension, and, therefore, enables the winch to be operated in a direction to unwind cable until the rocker reaches the maximum rotational position. However, upon the cable in the tension being reduced to the minimum cable tension value, switch 90 opens to prevent further unwinding of the cable, thereby maintaining the desired minimum cable tension. For a given length and spring constant for spring 84, the minimum cable tension sensed by the apparatus may be varied by appropriate positioning of switch 90 relative to plunger 80. Likewise, normally closed switch 92 is positioned relative to plunger 82 so that it is not actuated until the housing assumes a rotational position corresponding to the maximum desired cable tension (see FIG. 6C), at which point the switch opens to disable further operation of the winch in a direction to wind up cable. At intermediate rotational positions (such as shown in FIG. 6B) between those corresponding to the minimum and the maximum cable tension limits, the switches allow the winch to be operated in a normal manner to either wind up or unwind cable. The switches thus serve as detectors to detect the minimum and maximum cable tension limits and to control the operation of the winch so as to maintain the cable tension between such limits.

Additional switches may, of course, be provided for sensing predetermined intermediate cable tensions such as, for example, to indicate a preferred lifting load for a hoist. Also, it will be appreciated that other types of sensing devices may be employed, such as devices which provide a continuous read out of cable tension, and that a single plunger having one or more springs thereon may be used to actuate successive switches. It will also be appreciated that the invention is applicable to cable systems employing tension-applying devices other than winches, and that the invention is highly advantageous for controlling the tension in a remote cable system, particularly where an operator does not have visual access to the cable system, such as in combat vehicles of the type described where the operators are located within the vehicle and the cable system is located on the exterior of the vehicle.

While a preferred embodiment of the invention has been shown and described, it will be appreciated by those skilled in the art that changes may be made in this embodiment without departing from the principles and spirit of the invention, the scope of which is defined in the appended claims.

I claim:

1. Apparatus for maintaining the tension in a winch-controlled cable between minimum and maximum tension limits comprising a housing pivotally supported on a member for movement between first and second rotational positions, the housing having entrance and exit openings therein for the cable; first biasing means for biasing the housing to the first rotational position; a slidable pulley rotatably disposed within the housing with respect to the entrance and exit openings so as to enable the cable to be passed around the pulley and so as to cause the housing to pivot away from said first rotational position in accordance with the tension on the cable, second biasing means within the housing for biasing the pulley away from the entrance and exit openings for the cable, the first biasing means being selected such that the first rotational position of the housing corresponds to the minimum cable tension limit and such that the second rotational position of the housing corresponds to the maximum cable tension limit; first means for detecting the housing being at the first rotational position and for preventing operation of the winch to unwind the cable therefrom; and second means for detecting the housing being at the second rotational position and for preventing operation of the winch to wind up cable.

2. The apparatus of claim 1, wherein the first biasing means comprises first and second plungers extending through the member upon which the housing is supported, and first and second springs for respectively biasing the first and second plungers into engagement with the housing, and wherein the first and second detecting means comprise first and second switches, the first switch being positioned with respect to the first plunger so as to be actuated for all rotational positions of the housing other than the first rotational position, and the second switch being positioned with respect to the second plunger so as to be actuated only upon the housing being at the second rotational position.

3. The apparatus of claim 2, wherein the first spring has a spring constant and a length greater than the length of the second spring so that the first spring alone biases the housing toward the first rotational position for rotational positions of the housing between the first rotational position and an intermediate rotational position, and wherein the second spring has a spring constant greater than the first spring and a length such that the second spring is compressed only for rotational positions of the housing between said intermediate position and the second rotational position.

4. The apparatus of claim 3, wherein said second biasing means compensates for tension variations on the cable.

5. The apparatus of claim 4, wherein the tension compensating means comprises means for slidably disposing the pulley within the housing for movement between first and second linear positions in a direction substantially parallel to the direction in which the cable enters and exits the housing, and said second biasing means biases the pulley away from the entrance and exit openings for the cable toward the first linear position.

6. The apparatus of claim 1, wherein the apparatus is employed with a winch-operated retractable spade system for anchoring a gun-carrying vehicle in a selected emplaced position.

7. Apparatus for sensing the tension in a cable comprising a rocker pivotally supported on a member for rotation about a first axis; first means for biasing the rocker to a first rotational position; a slidable pulley rotatably carried by the rocker about a second axis substantially parallel to the first axis, means for slidably carrying the pulley on the rocker for linear movement between first and seocnd linear positions relative to the first axis upon tension being applied to the cable, second means for biasing the pulley to the first linear position, the cable being passed around the pulley and the second axis being located with respect to the first axis so as to cause the rocker to pivot away from said first rotational position and toward a second rotational position upon tension being applied to the cable, the second rotational position corresponding to a predetermined maximum desired cable tension; means for detecting the rocker being at the second rotational position; and means responsive to the detecting means for controlling the tension applied to the cable so as to maintain the tension less than or equal to said predetermined maximum desired tension.

8. The apparatus of claim 7, wherein the pulley is connected to a yoke which is slidably disposed within guide slots of the rocker, and wherein said other biasing means comprises a spring connected to the yoke and to one end of the rocker.

9. The apparatus of claim 8, wherein the rocker comprises an elongated housing enclosing the pulley, the yoke and the spring, and wherein the slots for the yoke are disposed in opposite sidewalls of the housing.

10. The apparatus of claim 9, wherein the cable enters and leaves the housing through a guide member located at another end of the housing.

11. The apparatus of claim 7, wherein said first rotational position of the rocker corresponds to a predetermined minimum desired cable tension, and wherein said detecting means comprises means for detecting the rocker being at the first rotational position, and the controlling means is responsive to the first position detecting means for maintaining the cable tension equal to or greater than said predetermined minimum desired tension.

12. The apparatus of claim 7, wherein the detecting means includes means for detecting the rocker being at intermediate positions between the first and second rotational positions.

13. The apparatus of claim 12, wherein the detecting means comprises first and second switches and plunger means arranged to engage the rocker and to actuate the first and second switches in accordance with the rotational position of the rocker.

14. The apparatus of claim 13, wherein the tension controlling means comprises a winch to which the cable is connected, and wherein the detecting means is arranged to prevent operation of the winch to unwind cable when the rocker is in the first position and to prevent operation of the winch to wind up cable when the rocker is in the second position.

15. The apparatus of claim 14, wherein the winch and cable are disposed on the exterior of a gun-carrying vehicle and are employed with a retractable group-engaging anchor for the vehicle.

16. The apparatus of claim 13, wherein the biasing means comprises spring means disposed about the plunger means, the spring means being compressed upon movement of the rocker toward the second position and being selected so as to permit the rocker to assume said first position upon the predetermined mimimum tension being applied to the cable and to assume said second position upon the predetermined maximum tension being applied to the cable.

17. The apparatus of claim 16, wherein the plunger means extends through said member upon which the rocker is supported, and said switches are disposed on an opposite side of the member from the rocker.

18. The apparatus of claim 17, wherein the plunger means comprises first and second plungers and the spring means comprises first and second springs disposed about the first and second plungers respectively, the first spring having a length greater than the second spring such that the first spring alone biases the rocker toward the first position for rotational positions of the rocker between the first position, the second spring having a length such that it biases the rocker toward the first position only for rotational positions of the rocker between the intermediate and the second positions.

19. The apparatus of claim 18, wherein the second spring has a spring constant greater than the first.

20. The apparatus of claim 19, wherein the second spring is positioned to enable the rocker to assume the second position upon said predetermined maximum tension being applied to the cable.

21. Apparatus for maintaining the tension in a winch-controlled cable between minimum and maximum tension limits comprising a housing pivotally supported on a member for movement between first and second rotational positions, the housing having entrance and exit openings therein for the cable; first means for biasing the housing to the first rotational position; a pulley rotatably disposed within the housing with respect to the entrance and exit openings so as to enable the cable to be passed around the pulley and so as to cause the housing to pivot away from said first rotational position in accordance with the tension on the cable, the biasing means being selected such that the first rotational position of the housing corresponds to the minimum cable tension limit and such that the second rotational position of the housing corresponds to the maximum cable tension limit; first means for detecting the housing being at the first rotational position and for preventing operation of the winch to unwind the cable therefrom; and second means for detecting the housing being at the second rotational poisition and for preventing operation of the winch to wind up cable, the first means for biasing the housing comprises first and second plungers extending through the member upon which the housing is supported, and first and second springs for respectively biasing the first and second plungers into engagement with the housing, and wherein the first and second detecting means comprise first and second switches, the first switch being positioned with respect to the first plunger so as to be actuated for all rotational positions of the housing other than the first rotational position, and the second switch being positioned with respect to the second plunger so as to be actuated only upon the housing being at the second rotational position, the first spring has a length greater than the length of the second spring so that the first spring alone biases the housing toward the first rotational position for rotational positions of the housing between the first rotational position and an intermediate rotational position, and the second spring has a spring constant greater than the first spring and a length such that the second spring is compressed only for rotational positions of the housing between said intermediate position and the second rotational position, means for compensating for tension variations in the cable by slidably disposing the pulley within the housing for movement between first and second linear positions in a direction substantially parallel to the direction which the cable enters and exits the housing, and second biasing means for biasing the pulley away from the entrance and exit openings toward the first linear position.

22. The apparatus of claim 21, wherein the apparatus is employed with a winch-operated retractable spade system for anchoring a gun-carrying vehicle in a selected emplaced position.

* * * * *

UNITED STATES PATENT AND TRADEMARK OFFICE

CERTIFICATE OF CORRECTION

PATENT NO. : 4,679,771

DATED : July 14, 1987

INVENTOR(S) : Johnson

It is certified that error appears in the above-identified patent and that said Letters Patent is hereby corrected as shown below:

ABSTRACT

Line 9, "proporational" should be --proportional--.

CALIMS

Column 7, line 38, "seocnd" should be --second--.

Column 8, line 46, after "position" insert --and a predetermined intermediate rotational position"

Signed and Sealed this

First Day of December, 1987

*Attest:*

DONALD J. QUIGG

*Attesting Officer*

*Commissioner of Patents and Trademarks*